United States Patent [19]

Knauf

[11] 4,114,838

[45] Sep. 19, 1978

[54] CARRIER FOR SKIS AND SKI POLES

[76] Inventor: James E. Knauf, 4425 E. 4th St., Long Beach, Calif. 90814

[21] Appl. No.: 743,927

[22] Filed: Nov. 22, 1976

[51] Int. Cl.[2] ..... A45C 71/00

[52] U.S. Cl. ..... 224/45 S; 280/11.37 A; 24/16 R

[58] Field of Search ..... 224/45 S, 58, 49, 55, 224/1 A, 1 R, 5 Z, 5 BC, 22, 5 R; 294/31.2, 74; 24/81 SK, 16 R, DIG. 18; 280/37.11 SK, 11.37 A; 2/323, 338

[56] References Cited

U.S. PATENT DOCUMENTS

| | | | |
|---|---|---|---|
| 2,076,925 | 4/1937 | Steinberg | 224/5 BC |
| 2,530,695 | 11/1950 | Helmert | 224/45 S |
| 2,699,284 | 1/1955 | Rose | 224/5 BC |
| 2,996,228 | 8/1961 | Bauman | 224/5 BC |
| 3,463,536 | 8/1969 | Updegraff et al. | 294/31.2 |
| 3,664,558 | 5/1972 | Tolliver | 224/1 R |
| 3,947,927 | 4/1976 | Rosenthal | 224/45 S |
| 3,960,302 | 6/1976 | Mazzoni, Jr. | 224/45 S |
| 3,985,275 | 10/1976 | Allen | 224/45 S |
| 4,002,277 | 1/1977 | Westerholm | 224/45 S |

*Primary Examiner*—Trygve M. Blix
*Assistant Examiner*—Kenneth Noland
*Attorney, Agent, or Firm*—Robert C. Comstock

[57] ABSTRACT

A carrier for skis and ski poles comprises an elongated main strap of webbing material. A pair of transversely directed short end straps are attached at their midportions to opposite ends of the main strap. The end straps carry complementary Velcro patches at their ends which hold the end straps in place around opposite ends of the skis. The end straps are slidably moved toward the midportion of the skis and are automatically tightened as they are moved. Rigid blocks at the strap intersections provide increased strength and security. The ski poles extend through slots formed adjacent opposite ends of the main strap. The midportion of the main strap is loose so as to fit over the shoulder of the skier for carrying both the skis and ski poles while leaving the hands free. The carrier can be folded upon itself into a compact self-holding package for carrying in the pocket.

4 Claims, 5 Drawing Figures

FIG. 1.
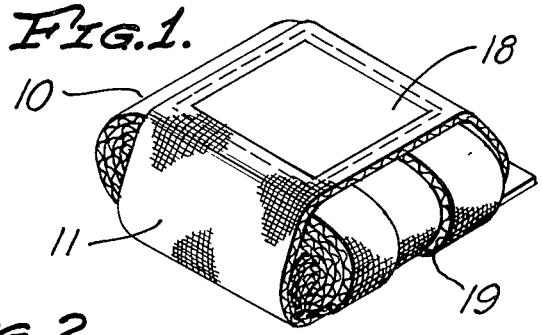
FIG. 2.
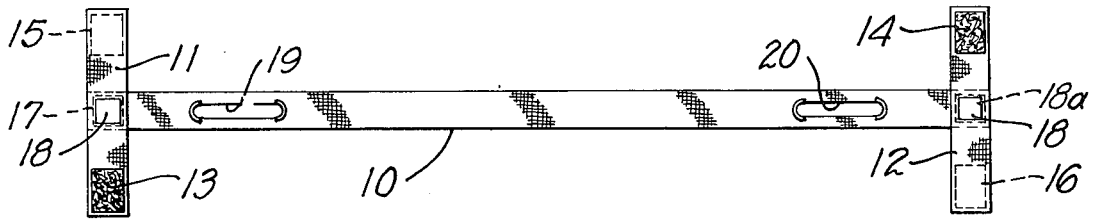
FIG. 3.
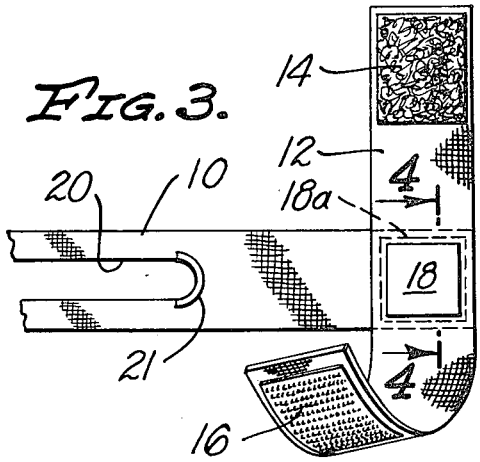
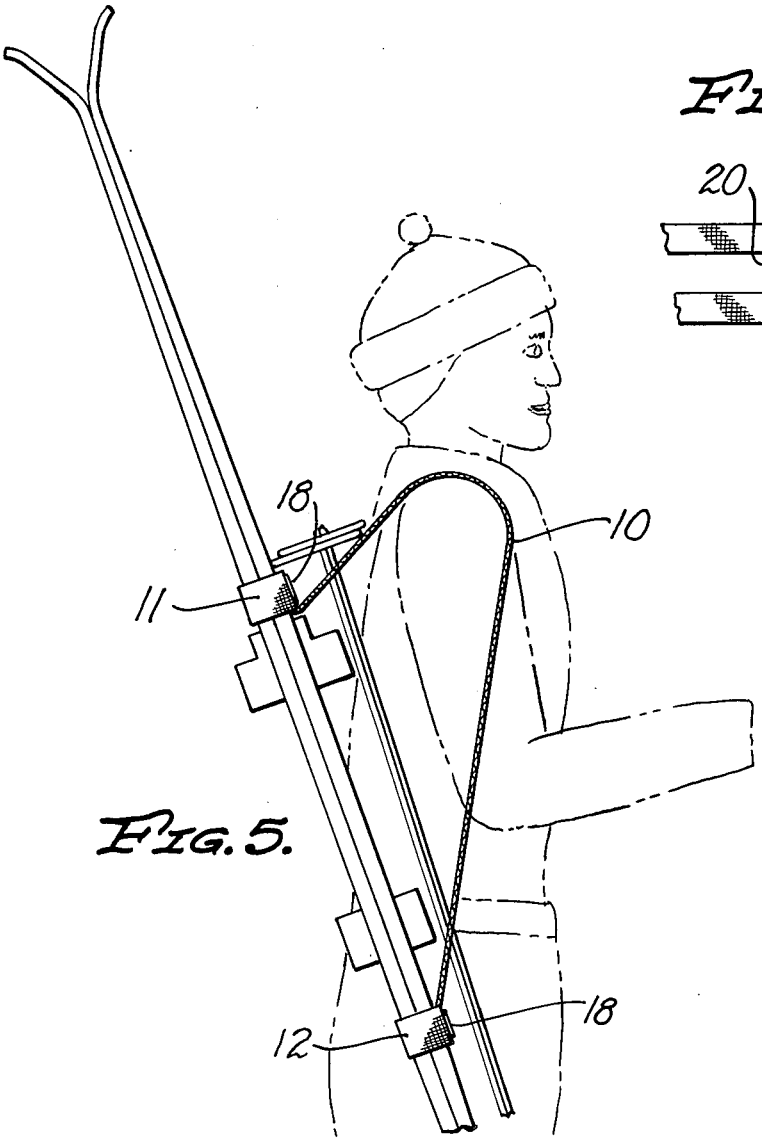
FIG. 5.
FIG. 4.
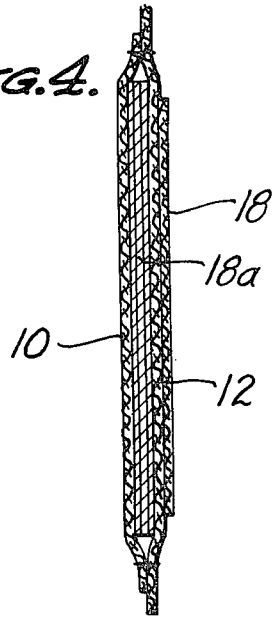

CARRIER FOR SKIS AND SKI POLES

BACKGROUND OF THE INVENTION

1. Field of the Invention

The invention relates to a carrier for skis and ski poles.

2. Description of the Prior Art

It is extremely difficult at the present time for skiers to carry their skis and poles to and from skiing areas. These articles are extremely long and awkward to handle. They customarily protrude in all different directions and it is difficult to avoid damaging them and possible injury to others while they are being carried.

There are some rubber straps now on the market having metal clamps which are used to attach the opposite ends of the skis to each other. They do not provide any carrying means or any provision for ski poles.

SUMMARY OF THE INVENTION

The present invention relates to an extremely simple and lightweight carrier which may be used to carry skis alone or skis and poles simultaneously.

The carrier of the present invention holds both the skis and the poles in a substantially vertical position closely adjacent to the body so that a substantial amount of protrusion and awkwardness are eliminated.

The carrier also fits over the shoulder, making the weight easier to carry and leaving the hands free for carrying boots, opening doors, etc. The carrier of the present invention can be easily and quickly attached to the skis and poles and can be removed easily and quickly as well.

When the carrier is not in use, it can be folded up into a compact package of small dimension and carried in the pocket of the skier. It is an object of the invention to provide a carrier for skis and ski poles having all of the advantages and benefits set forth above.

It is a further object of the invention to provide such a carrier which is formed of lightweight flexible material such as webbing made of polypropylene or other synthetic material.

Another object of the invention is to provide such a carrier which can be manufactured and sold at a substantially low price for widespread use. The carrier is also adapted to carry advertising of ski areas, manufacturers of ski equipment, etc.

It is a further object of the invention to provide such a carrier which is sturdy and long lasting in use and which will not become disconnected while in use.

The invention also comprises such other objects, advantages and capabilities as will later more fully appear and which are inherently possessed by the invention.

While there is shown in the accompanying drawings a preferred embodiment of the invention, it should be understood that the same is susceptible of modification and change without departing from the spirit of the invention.

DESCRIPTION OF THE DRAWINGS

FIG. 1 is an isometric view of the ski carrier in folded position for carrying in the pocket;

FIG. 2 is a top plan view of the open ski carrier ready for use;

FIG. 3 is an enlarged isometric view of one end of the ski carrier;

FIG. 4 is a sectional view taken on line 4—4 of FIG. 3;

FIG. 5 is an isometric view showing the ski carrier in use carrying both skis and poles.

DESCRIPTION OF THE PREFERRED EMBODIMENT

A preferred embodiment which has been selected to illustrate the invention is preferably formed almost entirely of strong webbing material, such as polypropylene or other suitable material.

An elongated main strap 10 may be made in one or more fixed lengths, or it may be made adjustable in length to fit various lengths of skis.

Attached to the opposite ends of the main strap 10, preferably by stitching, are a pair of transversely directed short end straps 11 and 12. The midportions of the end straps 11 and 12 are stitched to the ends of the main strap 10 to form a T configuration.

The inside of one end of each of the end straps 11 and 12 carries a substantially square patch 13 and 14 respectively of Velcro material. The outside of the opposite end of each of the straps 11 and 12 carries a substantially square patch 15 and 16 respectively of complementarily formed Velcro material. The Velcro patches 13–16 are preferably secured to the straps 11 and 12 by stitching. The ends of the main strap 10 preferably pass under the midportions of the end straps 11 and 12 in order to reduce stress on the stitching which is used to fasten the straps together.

A substantially square block 17 and **18*a* respectively, which may be formed of wood veneer approximately ⅛ inch thick or other suitable material is mounted between each end of the main strap 10 and the midportion of the adjacent end strap 11 and 12. The blocks 17 are preferably somewhat smaller in width and length than the webbing material used to form the straps. The blocks 17 and 18*a*** are accordingly held in place by being surrounded by four stitches which secure the straps together.

The midportions of the end straps 11 and 12 which form the "outside" may carry emblems 18 or other suitable marking so that the user can identify the proper direction of orienting the straps 11 and 12 in order to reduce stress on the stitches.

When the carrier is in use, the blocks 17 and **18*a* prevent the end straps 11 and 12 from buckling or riding up. They also act to reduce stress on the Velcro patches 13–16**, to prevent them from being pulled apart when the carrier is in use.

The main strap 10 is provided adjacent its opposite ends with a pair of identically formed elongated slots 19 and 20 respectively. The slots 19 and 20 are dimensioned to hold opposite ends of the ski poles when the carrier is in use. The opposite ends of the slots 19 and 20 may be reinforced by semi-circular grommets 21 formed of somewhat rigid nylon or other suitable material. The grommets 21 prevent any possible tearing or loose threads at the ends of the slots 19 and 20 and also provide a more finished appearance for the carrier.

The outside of the main strap 10 may carry advertising material or a trademark or the like.

In use, the end straps 11 and 12 are wrapped snugly around the opposite ends of the skis with the emblems 18 facing toward the outside. The ends of the straps 11 and 12 are brought together in order to place the Velcro patches 13–16 in overlying relationship to each other.

Manual pressure may be applied to provide secure engagement between the respective Velcro patches.

The straps 11 and 12 are then slidably moved toward the bindings of the skis, which are located adjacent their midportions. The skis are somewhat thicker toward the bindings and the camber of the skis causes their midportions to be spaced farther apart than their ends when the ends are disposed adjacent to each other. The straps 11 and 12 are accordingly tightened automatically as they are moved into positions preferably adjacent to and on opposite sides of the ski bindings.

The length of the main strap 10 may be adjusted, if desired, by moving the straps 11 and 12 away from or toward the bindings.

After the carrier is attached to the skis, the ski poles are inserted with the handles first through the slots 19 and 20. The handles of the ski poles should be directed toward the wear ends of the skis. The baskets of the ski poles fit adjacent the upper end of the upper slot 19 or 20 when the carrier is in use.

As illustrated in FIG. 5 of the drawings, the midportion of the main strap 10 is adapted to fit over the shoulder of the skier. The carrier then holds both the skis and ski poles in a vertical position substantially parallel to and closely adjacent to the body. The arms and hands of the skier are left free. The weight of the skis and ski poles is easily carried by the shoulder of the body.

When the carrier is not in use, such as when the user is skiing, one end strap may be folded in, the main strap folded upon itself and the other end strap secured around the assembly to form a complete self-holding package which may easily be carried in the pocket of the skier. (FIG. 1) In such folded position, its dimensions are approximately $1\frac{1}{2} \times 3\frac{1}{2} \times 3$ inches.

I claim:

1. A carrier for skis comprising an elongated main strap, an end strap extending transversely to said main strap adjacent to each end thereof, the midportions of said end straps being secured to the opposite ends of said main strap, a Velcro patch carried by the inside of one end of each of said end straps, a complementarily formed Velcro patch carried by the outside of the opposite end of each of said end straps, said Velcro patches adapted to engage each other to secure said end straps around said skis, each of said end straps being adapted to extend around one end of a pair of skis, said end straps adapted to be tightened by sliding movement from the end of said skis toward the midportion of said skis, said end straps in use being disposed adjacent to and on opposite sides of the bindings of said skis, and a pair of elongated slots formed in said main strap adjacent to the opposite ends thereof, said slots being adapted to hold the opposite ends of a pair of ski poles when said carrier is in use, said end and said main strap being foldable and then folding into a substantially thin compact package not substantially larger in either transverse direction than the width of said main straps and adapted to be held in such folded position by engagement between the Velcro patches of the other of said end straps.

2. The structure described in claim 1, and a substantially square rigid reinforcing block mounted between the midportion of each of said end straps and the adjacent end of said main strap.

3. The structure described in claim 2, the stitching extending along all four sides of each of said blocks to secure said end straps to said main strap and simultaneously hold said blocks in place.

4. The structure described in claim 3, and semi-circular substantially rigid reinforcing means extending around the end of each of said slots.

* * * * *